United States Patent [19]

Paillet

[11] 4,450,965

[45] May 29, 1984

[54] CONTAINER FOR PHARMACEUTICAL AMPULES OR THE LIKE

[75] Inventor: Bernard Paillet, Saint-Marcel-Bel-Accueil, France

[73] Assignee: Compagnie Francaise d'Emballages et de Conditionnement - COFREC, Montelimar, France

[21] Appl. No.: 204,348

[22] Filed: Nov. 5, 1980

[30] Foreign Application Priority Data

Nov. 8, 1979 [FR] France ..... 79 28017

[51] Int. Cl.[3] ..... B65D 81/02; B65D 73/00

[52] U.S. Cl. ..... 206/528; 206/485; 206/443; 206/446; 229/44 R

[58] Field of Search ..... 206/485, 528, 443, 446; 229/44 R, 37 R, 27, 28 R, 30

[56] References Cited

U.S. PATENT DOCUMENTS 977,305 11/1910 Heppe ..... 229/44 R
2,964,228 12/1960 Cote et al. ..... 229/44 R
3,693,865 9/1972 Desmond et al. ..... 229/44 R
4,144,996 3/1979 Kuckenbecker ..... 229/44 R

FOREIGN PATENT DOCUMENTS 501509 3/1951 Belgium ..... 206/485
1196194 5/1959 France ..... 229/44 R
413596 5/1946 Italy ..... 206/485
303037 10/1965 Netherlands ..... 206/485

*Primary Examiner*—Joseph Man-Fu Moy
*Attorney, Agent, or Firm*—Parkhurst & Oliff

[57] ABSTRACT

A container for pharmaceutical ampules is formed from a cardboard blank and including hollow lateral supports of rectangular cross section. Such cross section provides a series of parallel openings into which the ends of the ampules are placed. Each support includes a plurality of articulated flaps adapted to be folded against the ends of each support for reinforcing the rectangular cross section.

4 Claims, 32 Drawing Figures

FIG.16
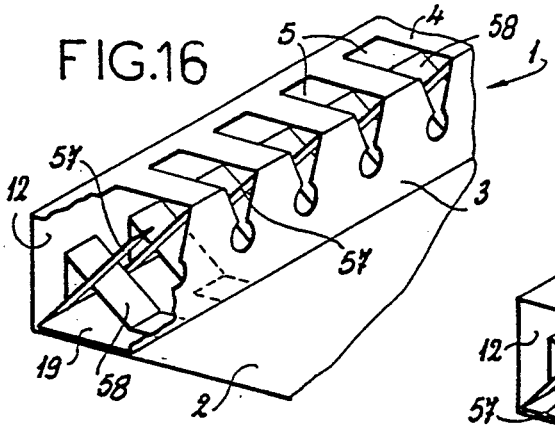
FIG.17
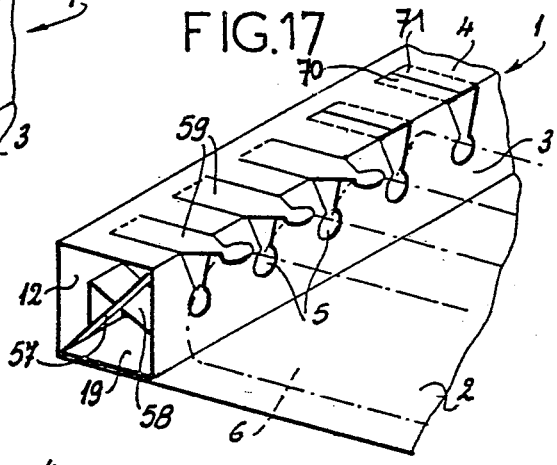
FIG. 18
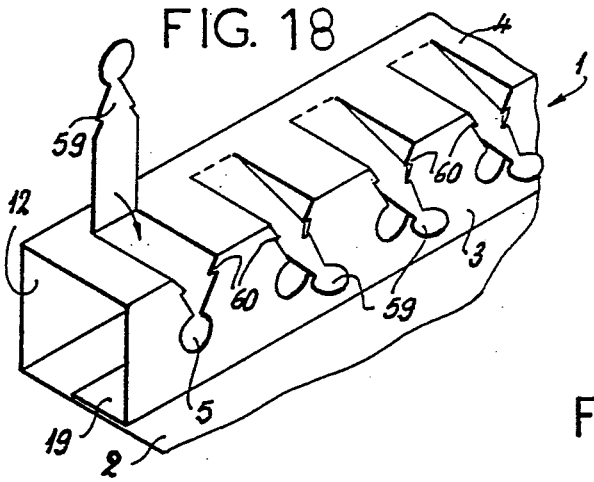
FIG. 19
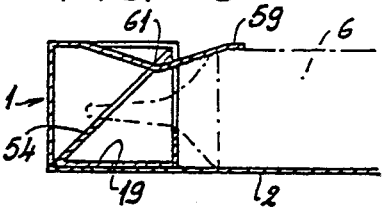
FIG.20
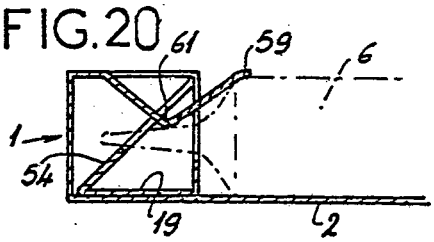
FIG.21
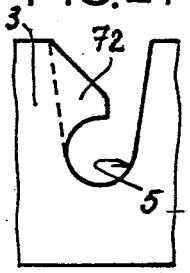
FIG.22
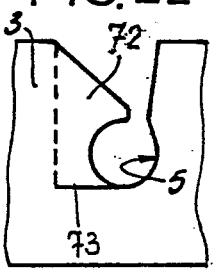
FIG.23
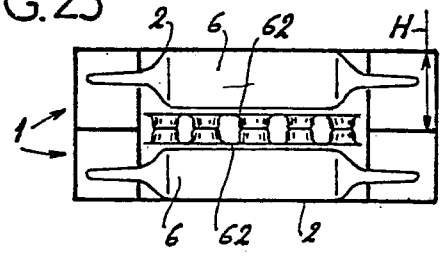
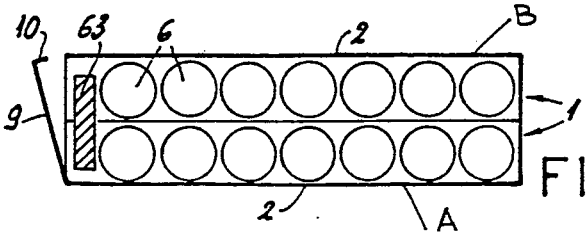
FIG.24

CONTAINER FOR PHARMACEUTICAL AMPULES OR THE LIKE

The present invention relates to a container for pharmaceutical ampules and for similar packagings, such as ampule bottles and flasks, belonging to the type formed from a cardboard blank and having hollow lateral supports of rectangular cross section provided with a series of openings into which the ends of the ampules or the like are introduced, connected by a flat bottom.

The traditional containers for ampules consist of boxes having a bottom, side walls and a hinged cover, in which there are arranged superimposed racks formed of two longitudinal supports connected by a rectangular bottom. These racks may also be placed within a case which opens at one of its ends by means of a hinged closure flap. The supports of the traditional racks are of triangular section, but racks whose lateral supports are of rectangular section are also known.

In general, the present ampule containers require large amounts of cardboard for manufacture for two reasons, namely:

first of all, the very structure of these containers, which has been pointed out above (box plus racks or case plus racks) requires a large surface of cardboard, furthermore, the lack of rigidity of these containers makes it necessary to use relatively thick cardboard in order to obtain a desirable certain amount of mechanical strength.

It will be understood that this leads to a high cost of the containers and to insufficient protection of the ampules contained in these containers, thus making it necessary to use very strong boxes for the consolidated shipment of the containers, this being an additional cost.

With respect to the mechanical strength of the ampule containers it is advisable to obtain, insofar as possible, resistance to crushing and to impacts, whatever the direction of the various pressure forces and stresses to which the container may be subjected. In the case of the conventional boxes with bottom, side walls and hinged cover, the package opposes average resistance to forces acting on the bottom or lid, but offers very little or even no resistance to forces acting on the side walls. With cases, the resistance to the forces applied to the ends is average while the resistance to forces applied to the different longitudinal walls is very slight or even nil. These drawbacks result both from the general structure of the container and from the fact that the racks arranged within it have practically no resistance of their own.

Various attempts have already been made to improve the strength of ampule containers but they have given little satisfaction. The problem has been viewed only in partial fashion, for instance by trying to reinforce only the racks and not modifying the overall structure of the containers, and the solutions proposed have frequently led to a substantial increase in the amount of cardboard necessary, and even to a multiplication of the number of parts necessary for the production of a container.

In French Pat. No. 1,291,675 a new type of single bottom container is described which is provided on a single bottom with two side supports of rectangular parallelepiped shape provided with the customary openings for the holding of ampules, in which:

each of the supports is interrupted in its center over a distance equal to twice the height of the supports;

transverse fold lines are provided on the bottom for right-angle folding along these lines as hinges between the two portions of the container on which the container subsists.

Unfortunately, this type of container poorly withstands the different pressures or deformations and the annoying tendency to sag. Thus in actual practice it is supplemented by a case within which it is frictionally fitted, with the open portion towards the front. However, even within this lining case, the package still becomes deformed and in particular, when the case is removed, the supports hold the ampules poorly, allowing them to escape therefrom. Furthermore, this solution still makes use of a case, resulting in a considerable consumption of cardboard.

In French Pat. No. 1,114,066, another type of container is described in which the ampules serve as braces for the supports, which therefore have no particular strength of their own.

Furthermore, even with the ampules the strength of the package as a whole is still poor unless here again a case or sheathing is employed.

In the first Certificate of Addition No. 72.562 to this French Pat. No. 1,114,066 it has been suggested that the unit be strengthened by providing in its bottom a provisional flat which holds the supports in the desired position during the putting in place of the ampules. Furthermore, it has also been proposed to make the supports non-deformable by means of foldable tabs located at the end of the supports.

However, here again, in view of the absence of any connection between the ampule support and the container support, the strength of the package as a whole is not sufficient and in practice it is still necessary to resort to a case, which substantially increases the cost of these products.

The present invention is directed at providing a package of the type in question which is complete, that is to say does not resort to a case, sheathing or the like intended to strengthen the racks.

It is also directed at providing a compact package formed of a single part and cut from a single piece of cardboard, which is easy to produce, store and shape and which, once fitted, is of excellent non-deformability.

This container for ampules or the like, cut from a single blank of cardboard or the like, of the type having two foldable unit portions, each formed of two hollow parallel lateral supports of rectangular section connected together by a flat bottom, said lateral supports being provided with openings intended to receive the ampules, the two unit portions being in their turn connected and articulated to each other by a hinge-shaped portion the width of which is substantially equal to the sum of the heights of the lateral supports, is characterized by the fact that it is provided, at least at each end of the lateral supports, with reinforcement means intended to make the lateral supports rigid.

In other words, this container is formed simply of two portions connected to each other which assure both the function of holding the ampules and the function of closing the container, making it possible to produce the entire container in a single piece and in particular from a single blank of cardboard and constituting a first saving of cardboard. Furthermore, the reinforcement of the supports at least at their ends and possibly over their entire length make it possible to use thinner cardboard, a second saving, while obtaining better resistance of the container to crushing and impacts and therefore improved protection of the ampules. In this connection it will be noted that the lateral supports with their rectangular section and their reinforcement means constitute a rigid "girder" structure which offers very good resistance to the pressures exerted on the upper, lower and side faces of the closed container and an exceptionally high resistance to longitudinal forces exerted on the ends of the container. The saving of cardboard as compared with the present ampule containers may amount to 50% and more in weight of cardboard. The total cost of manufacture of the container of the invention can also be reduced in a ratio on the order of 1/2 as compared with the present embodiments since the manufacture of this container can be effected with the conventional machines used by cardboard fabricators, at industrial rates and employing the customary methods of assembly such as gluing, stapling and interengagement.

While, generally speaking, the package is made of cardboard, it can also be made of other semi-rigid or rigid materials such as plastic.

The ampule container in accordance with the invention, formed of two portions which are foldable one against the other and which can also be placed flat in the extension of each other, furthermore is of an improved shape for the user, being more attractive and of more practical use. The lateral supports can be printed without increase in cost and can thus bear legends which are clearly visible in the open position of the container, assuring better giving of instructions and therefore greater reliability for the user.

The invention also offers a large range of possible embodiments with respect on the one hand, to the development of the articulation between the two portions of the container and, on the other hand, the shaping of the reinforcement means for the supports.

In a first embodiment, the reinforcement means for the supports comprise one or more flaps which are articulated to the ends of the supports and adapted to be folded over towards the inside of the supports. These flaps, which prevent the deformation of the supports and assure the resistance of the container, can be provided on the initial blank without increasing the required area of cardboard, in particular by using the areas available on each side of the connecting face which connects the two parts of the container. In accordance with one possible embodiment, two reinforcement flaps are provided at the ends of the supports, one of them being articulated to the inner face and the other to the outer face of the corresponding support, these two flaps being folded over towards the inside of the support and held in particular by interengagement with each other. In accordance with another embodiment, a single reinforcement flap is provided at the ends of the supports, it being articulated to the inner, upper or outer face of the corresponding support, this single flap being folded over towards the inside of the support and being held in particular by means of a tongue or folded portions, or else pushed by force into the support and/or held by cardboard breaks provided in the support.

Various possibilities exist for the practical embodiment of the hinge connecting the two elementary parts.

In a first general solution, the bottoms of the two portions of the container are connected together by two adjacent rectangular faces, the width of which is substantially equal to the sum of the heights of the supports, these two faces being folded against the corresponding ends of the supports. The axis of the hinge is thus represented by the connecting line between the two faces in question. In this case it is, however, advisable to carry out an additional assembly operation which may give rise to several variants, namely:

1. The two rectangular faces which are folded against the corresponding ends of the supports are fixed against said ends, in particular by gluing or stapling on flaps which close said ends.

2. The two faces in question are not fastened directly but the ends of the upper faces of the supports of the two parts of the container, brought together by the folding of said faces, are hooked to each other in particular by means of a tongue which forms an extension of the upper face of one support and cooperates with a flap provided with a slot or notches present on the upper face of the other support.

3. Each of the adjacent ends of the upper faces of the supports of the two portions of the container have a tongue, the two adjacent tongues being staggered laterally and being engaged through slots provided in the said two adjacent In a second solution for the production of the hinge in question, the corresponding ends of the upper faces of the supports of the two parts of the container are directly connected to each other along fold lines.

In yet another solution, which can be contemplated either by itself or in combination with the preceding solution, the two portions of the container are connected to each other by an attached piece of cardboard comprising two adjacent rectangular faces, the connecting line of which constitutes a hinge axis. Each of these faces has at least one flap folded at a right angle and fastened to the bottom of one of the parts of the container. Preferably the two rectangular faces furthermore have lateral tabs, folded at a right angle and fastened to the ends of the outer faces of the corresponding supports, the two tabs located on the same side of the container possibly being advantageously connected initially by an attachment point which assures the inviolability of the container.

In accordance with another embodiment of the ampule container forming the object of the invention, this container is made from two identical initially separate parts, each of which has two supports connected by a bottom, and is extended at one end by a foldable closure tab. One thus has a structure with two identical "half boxes" which are connected to and brought against each other so as to constitute the closed complete container.

The means for the reinforcement of the lateral supports may also comprise, for each support, at least one element arranged on the inside of the support, along a diagonal of the rectangular section of the support, possibly having a series of notches corresponding to the openings into which the ends of the ampules are introduced so as to constitute a "triangulation". These elements make it possible to maintain the supports in shape and reinforce them over their entire length, either alone or in combination with reinforcement flaps provided at the ends of the supports without resulting in any interference in the region where the tips of the ampules are. In order to obtain maximum rigidity, the reinforcement of the supports is preferably effected by "double triangulation", reinforcement elements being arranged on the inside of each support along two perpendicular directions which intersect, these reinforcement elements being in particular formed of transverse tabs extending from the same longitudinal flap and alternating with each other, some being arranged opposite the openings into which the ends of the ampules are introduced while the others are located between the openings.

In accordance with another characteristic of the invention, the parts of the initial blank which are intended to form the openings into which the ends of the ampules are introduced are cut out while remaining attached, at one end or a side, to the corresponding support, so as to constitute tongues which assure an individual wedging of the ampules. These tongues assure a reliable locking and holding of the ampules on the supports of the two parts of the container, whatever the dimensional tolerances of the container and of the ampules. They permit the opening and closing of the container without the risk of the ampules becoming loose unintentionally and they can also prevent the lower and upper ampules from striking each other. An interlocking of the ampule wedging tongues can be effected on the inner faces of the supports or on the diagonal reinforcement elements arranged within the supports. In order to assure a perfect holding of the ampules whatever the dimensional tolerances of their tips, the openings into which these tips are introduced may also be cut in particular manner, with a pivoting lateral nose for the holding of the ampule tips, particularly when the filled container is closed to form the box by folding the two halves one against the other.

In accordance with still another embodiment, the reinforcement means provided in the regions of the ends of the support are formed in part of protruding lateral elements borne by a closure tab of the container and entering into the supports.

Finally, the ampule container which is the object of the invention may have, at one end, a portion which can be detached along a precut line which passes through two supports and traverse the bottom connecting these two supports, said detachable portion including a closure tab for the container and constituting, after its separation from the rest of the container, a case for one or more ampules. This arrangement makes it possible, without additional cardboard and without increase in the cost of the container, to produce a case for one or more ampules which the user can easily carry along with him in order to take with him the daily dose contemplated for ambulatory treatment without danger.

In any event, the invention will be better understood and other characteristics will become evident from the following description, read with reference to the accompanying diagrammatic drawings which show, by way of illustration and not of limitation, several embodiments of this container for pharmaceutical ampules and the like wherein:

FIG. 16 is a perspective view similar to FIG. 15 illustrating a variation of the reinforcement by "double triangulation";

FIG. 17 is a partial view in perspective of a container in accordance with the invention showing the wedging of the ampules by means of tongues cut out from the supports;

FIG. 18 shows, in perspective, a variation of the container of FIG. 17, with interlocking of the tongues on one face of the supports;

FIGS. 19 and 20 are partial views in cross section illustrating two other variations in which the wedging tongues are interlocked on the diagonal reinforcements of the supports;

FIGS. 21 and 22 are diagrams showing openings which receive the ampule tips, with pivoting lateral noses for the holding of them;

FIG. 23 is a diagrammatic cross-sectional view of a container in accordance with the invention designed to receive, in addition to ampules, also pills in "blisters" or other accessories;

FIG. 24 is a diagrammatic longitudinal section through a container in accordance with the invention designed to receive an accessory intended for the opening of the ampules;

Figure 1:
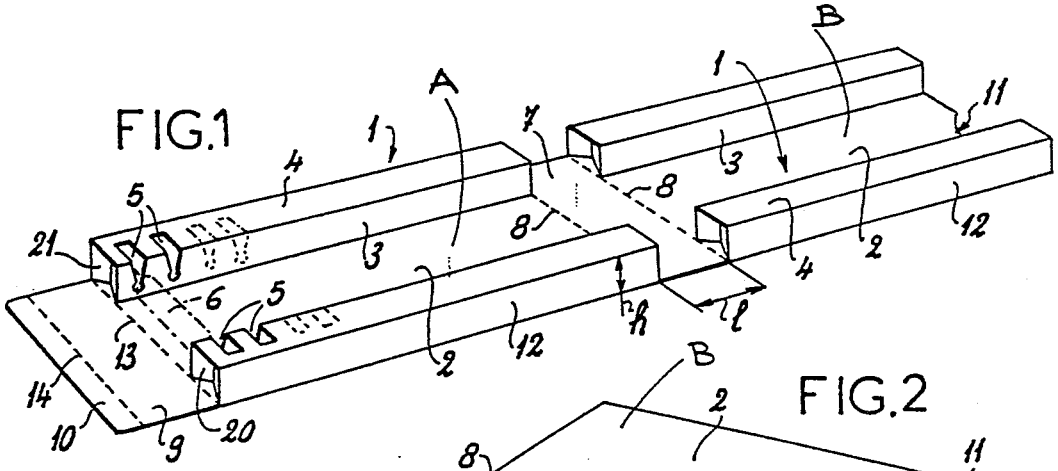
FIG. 1 is a perspective view of a container in accordance with the invention, shown in open position.

The container shown in FIG. 1 comprises two elementary portions A and B, each of which is formed of two hollow, parallel lateral supports 1 of rectangular section connected by a flat bottom 2. In known manner, the supports 1 are provided on their faces 3 which face each other and on their upper faces 4, with a series of openings 5 ordered face to face or in quincunx into which the points of the ampules 6 are introduced.

The bottoms 2 of the two portions A and B of the ampule container in question are connected together by a rectangular face 7 whose width 1 is substantially equal to the sum of the heights h of the supports 1. This face 7 is connected to the bottoms 2 on its larger sides by two parallel fold lines 8 so as to form a hinge.

While most generally the supports 1 have the same height h, they might also be of different height in order to permit the packing of objects of different size, for example, ampules on the one side and bottles on the other.

In known manner, the bottom 2 of the portion A of the container is extended, at the end opposite the corresponding fold line 8, by a foldable tab 9, which itself has a tongue 10. As to the other portion B of the container, its bottom is provided with a notch 11 at the end opposite the corresponding fold line 8.

Figure 2:
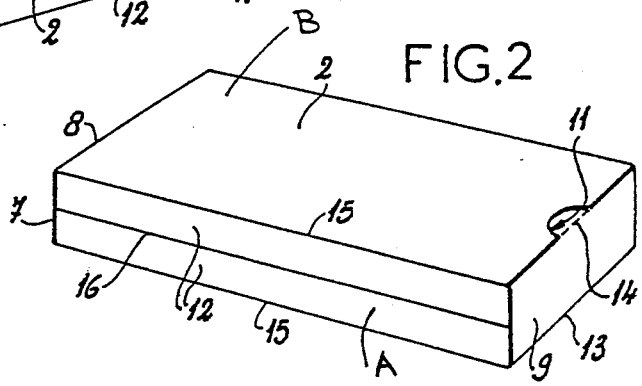
FIG. 2 is a perspective view of the same container, shown in closed position.

As shown in FIG. 2, the arrangements described above make it possible to close the container by placing one of the two portions A or B against the other and using the tab 9 together with its tongue 10 as a closure tab. The container is then in the form of a completely closed parallelepiped box, the different faces of which consist of the two bottoms 2, the face 7, the closure tab 9 and the outer faces 12 of the four supports 1.

Figure 3:
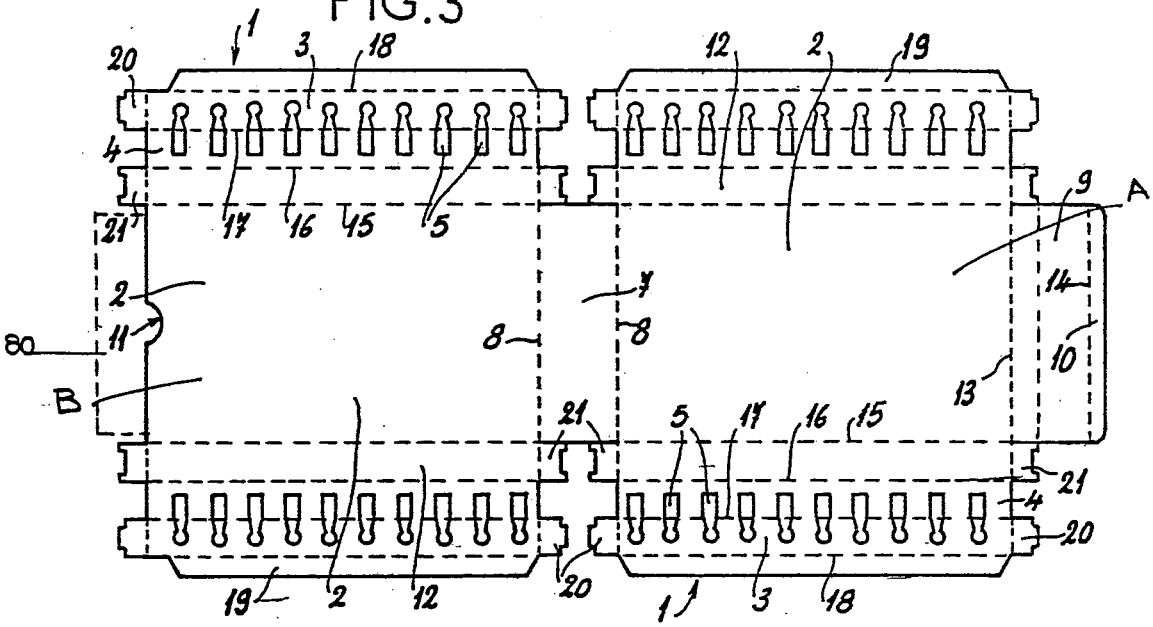
FIG. 3 shows, seen in top view, the blank from which a container such as shown in FIGS. 1 and 2 can be produced.

In another variation, the bottom 2 of the portion B is extended at the end opposite the fold line 8 by a foldable tab represented by the dashed line 80 in FIG. 3, which tab is fastened to the ends of the lateral supports by means of flaps 20, 21 37. The tab 9 provided without tongue 10 but with a tearable cutout partially glued onto the end of the portion B assures the inviolability of the container and allows the possibility of the customer opening the container by tearing off the strip produced on the tab 9.

The container shown in FIGS. 1 and 2 is made from a single blank of cardboard, as shown in FIG. 3, on which there are present, of course, the two bottoms 2, the intermediate face 7 connecting these two bottoms by means of the fold lines 8, the closure tab 9 and its tongue 10 with the corresponding fold lines 13 and 14, as well as the different faces 3, 4 and 12 intended to form the supports 1. These faces are bounded by parallel fold lines 15, 16 17 and 18. The inner faces 4 of the supports 1 also have a lateral flap 19 which is folded at a right angle and glued to the bottom 2 of the container portion in question.

Figure 4:
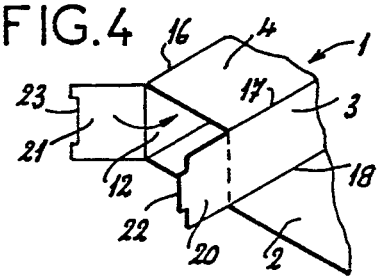
FIG. 4 is a partial view in perspective of one end of the container of FIGS. 1 and 2, showing the detail of the reinforcement flaps.

In accordance with the invention, the container of FIGS. 1 to 3 furthermore has, as shown more particularly in FIG. 4, reinforcement flaps 20, 21, located at the two ends of the individual supports 1. The flaps 20 are articulated to the ends of the inner faces 3 of the supports 1 while the flaps 21 are articulated to the ends of the outer faces 12 of the supports 1. These flaps are of generally rectangular shape but the flaps 20 have a tongue 22 opposite the line of connection to the corresponding face 3 while the flaps 21 have a notch 23 on the side facing away from the line of connection to the corresponding face 12. The two flaps 20 and 21 located at each end of a support 1 are folded over towards the inside of said end as illustrated by the arrow in FIG. 4 and they are held within said end by the hooking of the tongue 22 of one into the notch 23 of the other, thus forming a triangulation.

Figure 5:
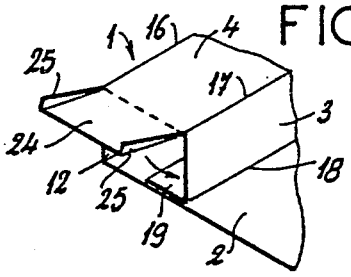
FIGS. 5, 6, 7, 8 are perspective views similar to FIG. 4 illustrating different variations of the reinforcement flaps located at the ends of the supports of the container.

FIG. 5 shows another variation, in which a single reinforcement flap 24 is provided at each end of the individual supports 1. These flaps 24 are articulated to the ends of the upper faces of the supports 1. They have a generally rectangular shape, with two portions 25 folded along their opposite two free edges. Each flap 24 is folded over the inside of the corresponding end of the support 1, as illustrated by the arrow in FIG. 5, and is held within said end by the cooperation of its two folded portions 25 with the inner face 3 and outer face 12 of the support 1. This flap 24 can also be made without the folded portions 25 and with a height greater than the inner height of the support 1 so as to permit blocking on the bottom of the support; cardboard bursts on the faces 3 and 12 of the support possibly completing the blocking of the flap in question.

Figure 6:
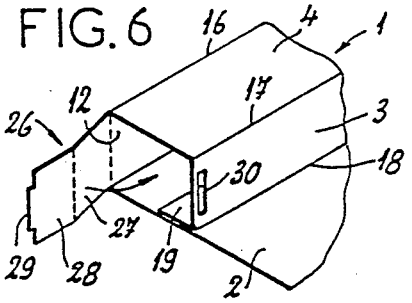

FIG. 6 shows a second variation in which a single reinforcement flap 26 is also provided at each end of the different supports 1. These flaps 26 are articulated to the ends of the outer faces 12 of the supports 1. They are of a generally rectangular shape and are divided into two portions 27 and 28 by a central fold line. The edge of each flap 26 which faces away from the line of connection to the corresponding face 12 has a tongue 29. The flap 26 is folded in a V and introduced into the end of the support 1, as illustrated by the arrow in FIG. 6, and is held within said end by the engagement of the tongue 29 in a slit 30 provided in the corresponding end of the inner face 3 of the support 1.

Figure 7:
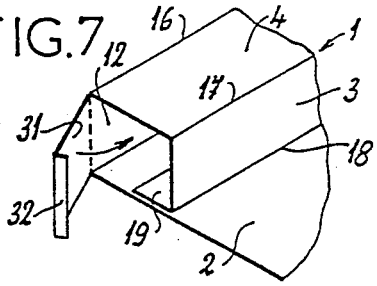

FIG. 7 shows a third variation in which, as previously, a single reinforcement flap 31, of generally rectangular shape, is provided at each end of the different supports 1 and, more particularly, is articulated to the end of the outer face 12. This flap 31 is extended by a tongue 32 which is folded inwards. It is introduced into the end of the support 1, as illustrated by the arrow in FIG. 7, and it is held within the latter by the cooperation of its tongue 32 with the inner face 3 of the support 1.

Figure 8:
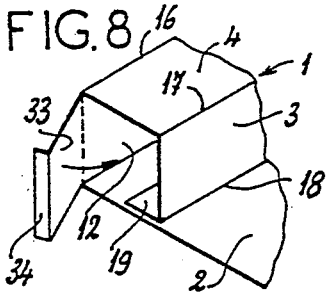

Finally, FIG. 8 shows a fourth variation which differs from the preceding one by the fact that the single flap 33 in this case has a tongue 34 which is folded towards the outside and not towards the inside. Other suitable methods of fastening the flaps which have not been shown include stapling or the like.

It is to be noted that the production of the container from a blank, such as illustrated in FIG. 3, offers in all cases areas available for the formation of the reinforcement flaps located at the ends of the supports 1, particularly in the central region where the two portions of the container meet along the face 7. This is clearly shown in FIG. 3 in the particular case in which two flaps 20 and 21 are provided at each end of a support 1. In the cases of FIGS. 6 to 8, and if the length of the single flaps 26, 31 or 36 requires this, it can be provided that they are alternately attached to the inner face 3 and outer face 12 of the supports 1, so as to overlap in the available areas.

Figure 9:
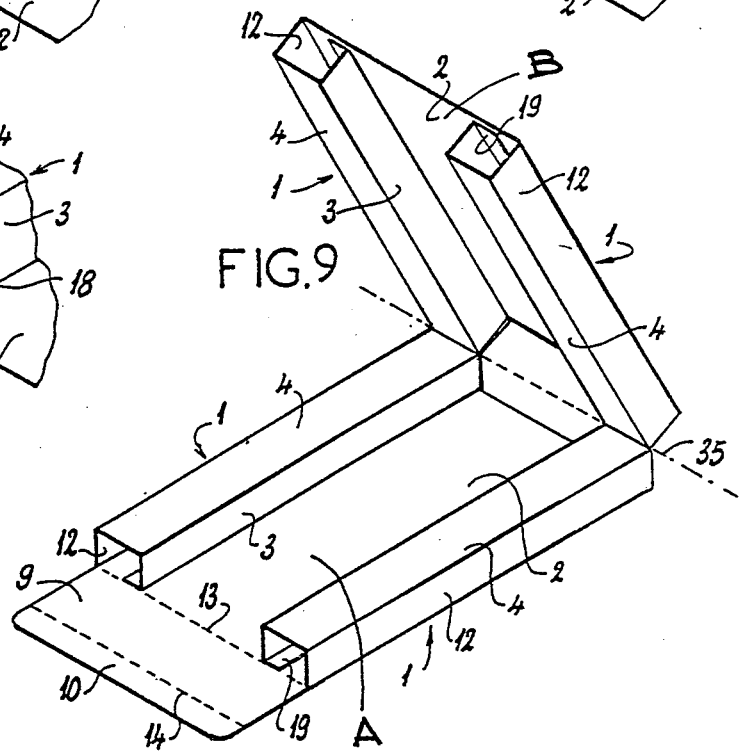
FIG. 9 is a perspective view of another embodiment of the container of the invention, shown in partially open position.

FIG. 9 shows a container for ampules which also has two similar portions A and B, each of which has two parallel lateral supports 1 of rectangular section, connected by a flat bottom 2. In order to simplify the drawing, the openings which receive the tips of the ampules have not been indicated. The bottom 2 of each of the two portions of the container can, as previously, be extended by a closure tab 9 provided with a tongue 10. Contrary to the case of FIGS. 1 to 3, the two portions of the container are not connected by a face articulated to the two bottoms but are articulated directly to each other along an axis 35 which passes through one end of all the upper faces 4 of the different supports 1, which also makes it possible to close the container by bringing one of the two portions against the other.

Figure 10:
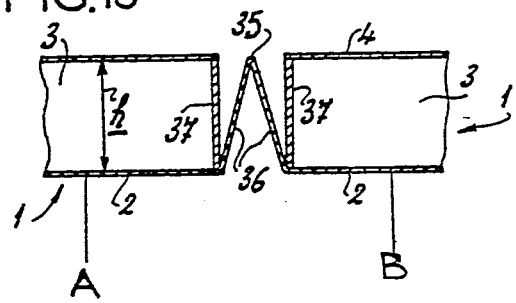
FIG. 10 is a partial view, in longitudinal section, showing the region of the "hinge" of another container in accordance with the invention.

In the case of FIG. 10 which is a partial view in longitudinal section through two supports 1 of the container of the type shown in FIGS. 1 to 3, the bottoms 2 of the two portions A and B of the container are connected together by two adjacent rectangular faces 36, formed in the junction face 7 of the portions A and B, the junction line of which physically represents an axis of articulation 35. The width of each of these two faces 36 is substantially equal to the height h of the supports 1. The two faces 36 in question are folded against the corresponding ends of the supports 1, and they can be fastened by gluing or stapling on flaps 37 which close the ends of the supports 1.

Figure 11:
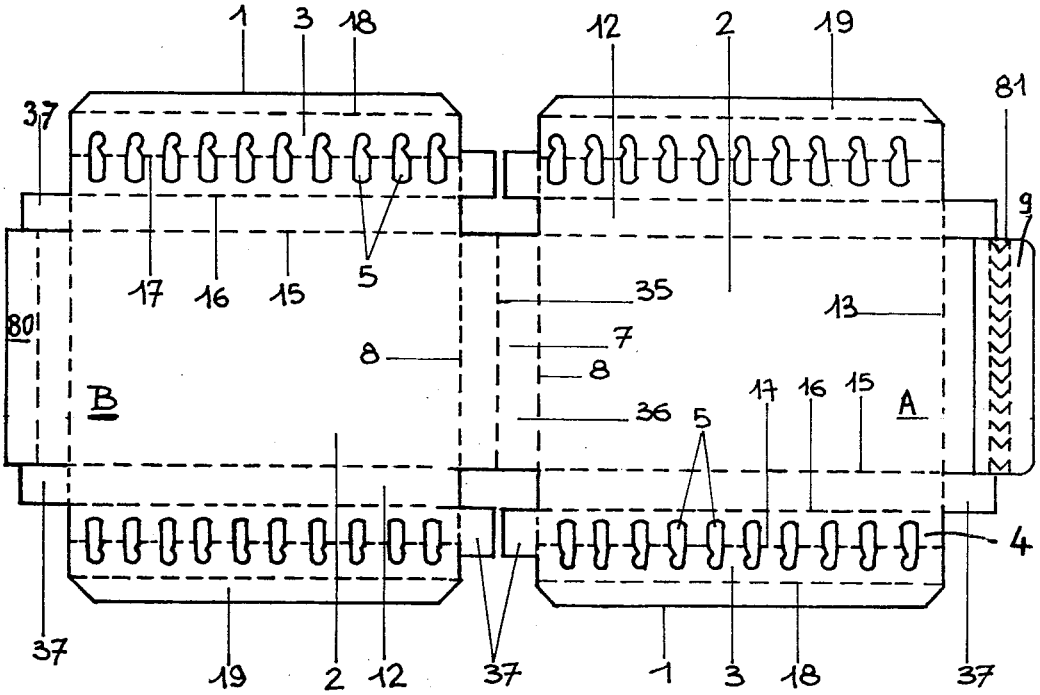
FIG. 11 is a top view of a blank from which a preferred container in accordance with the invention, as shown assembled in FIG. 28, can be produced.

These rectangular flaps 37 (see FIG. 11) adjoin one of the three faces of the lateral support (the outer face in the case shown in the drawing). Identical flaps are also arranged at the other ends of the lateral support.

Figure 28:
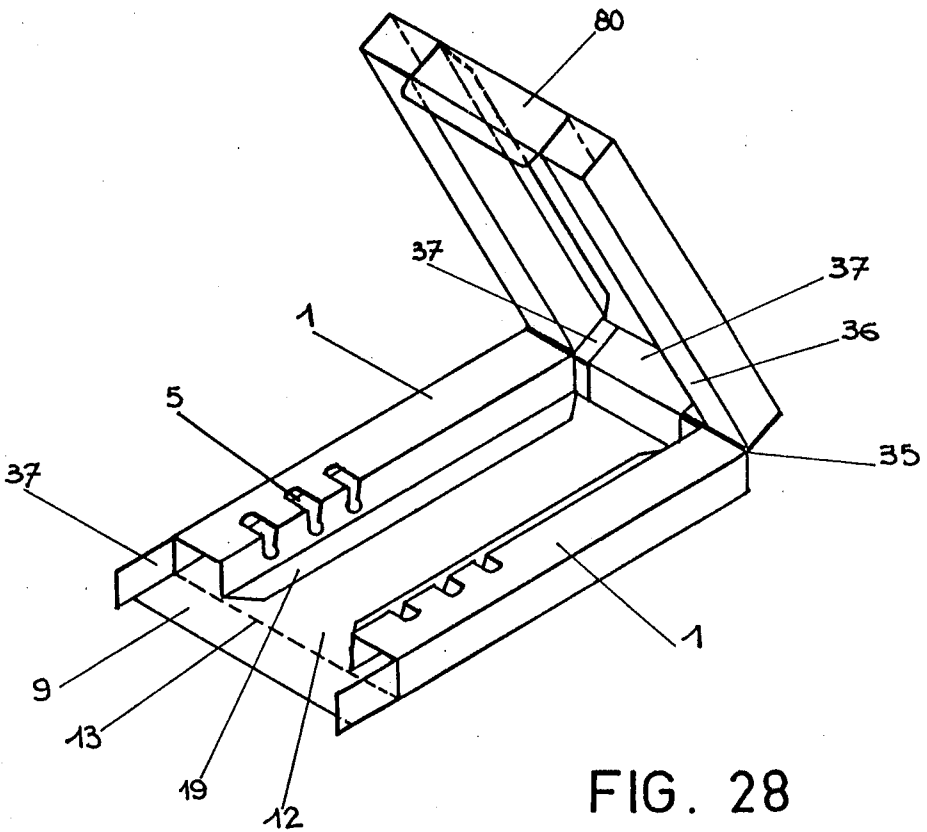
FIGS. 28 to 32 show two improvements with an interpolated to avoid the knock of the ampules.

The reference number 81, shown with arrows, designates the portion which can be torn off. Upon folding, the flaps 37 are brought onto each of the ends of the lateral supports 4 and these flaps 37 are secured by any suitable means, preferably by gluing, to the connecting faces 36 in the case of the central portion, the outer faces 9 and 80 respectively so as in particular to close off the ends of the lateral supports and strengthen the assembly (see FIG. 28). A perfectly stabilized container is thus obtained.

Figure 12:
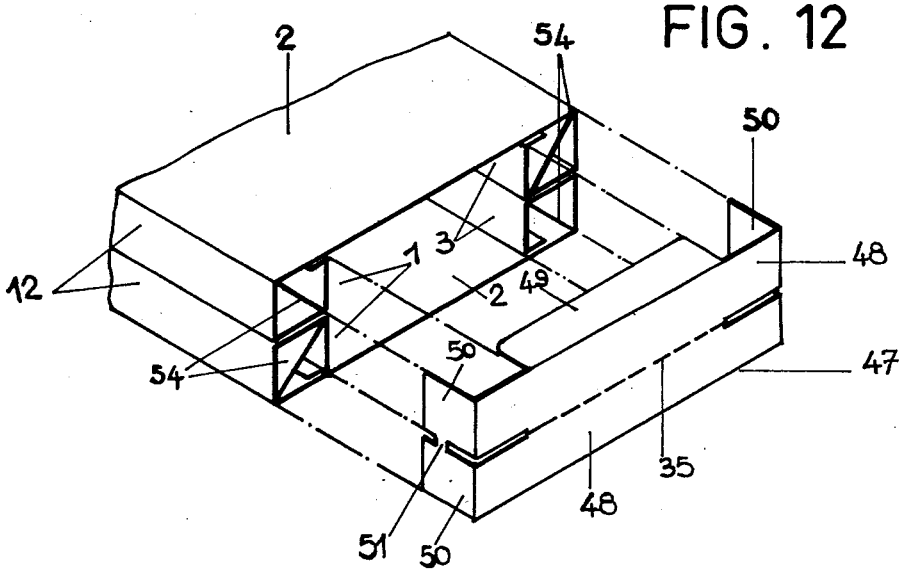
FIG. 12 is a partial view in perspective showing a container of the kind shown in FIG. 9 in which the hinge is developed by means of an attached part (shown separated from the rest of the container)

FIG. 12 shows in further detail an embodiment in accordance with the principle of FIG. 9 in which the two portions of the container are connected by an attached piece of cardboard designated generally as 47, which produces the hinge. The piece 47 comprises two adjacent rectangular main faces 48, the junction line of which represents the axis of articulation 35. The longitudinal face of each face 48 arranged away from the line 35 has a flap 49 bent at a right angle. The two small sides of the faces 48 are extended by tabs 50, also folded at a right angle. The attached piece 47 is applied against the regions of the two portions of the container, to be connected, which have been brought against each other, in such a manner that the faces 48 close one end of the container. Each flap 49 is glued to the bottom 2 of one of the portions of the container, on the inside or outside of the container. The lateral tabs 50 are applied to and glued against the corresponding ends of the outer faces 12 of the different supports 1. The two tabs 50 located on the same side of the container can be connected initially by an attachment point 51 which assures the inviolability of the container until it is used. In accordance with another possibility, the flaps 49 are not glued but are simply introduced into the two portions to be connected, between their two supports 1.

Figure 13:
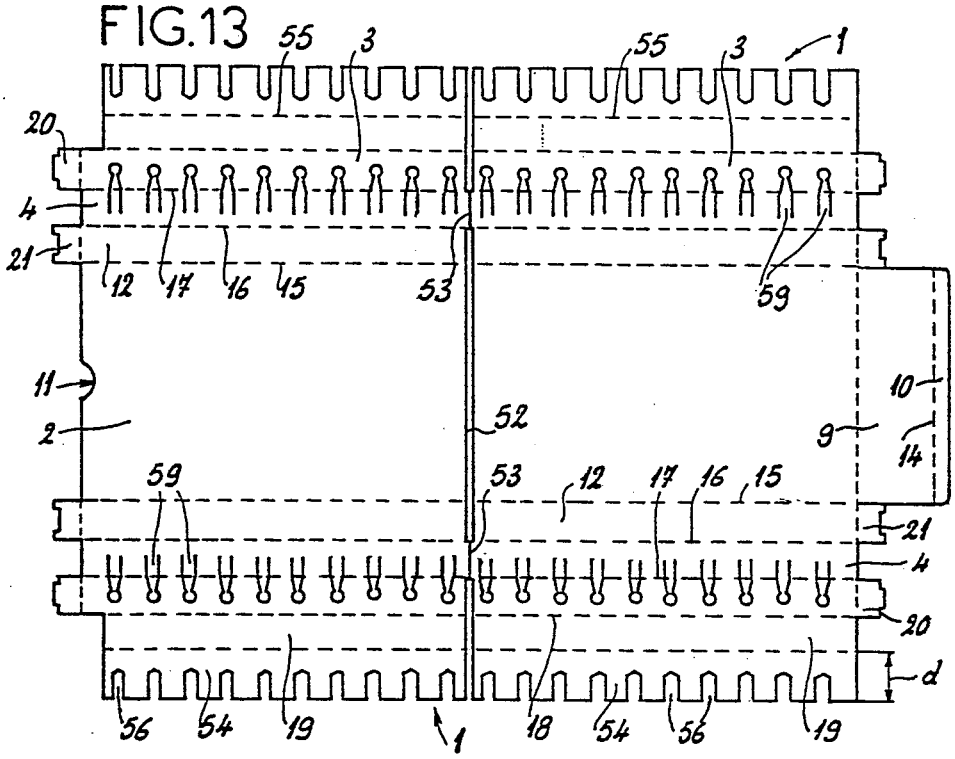
FIG. 13 shows seen in top view, the blank from which a container such as that of FIG. 12 can be developed.

The container shown in FIG. 12 can be produced from a cardboard blank, shown in FIG. 13, which must of course be supplemented by a secondary blank which forms the attached piece 47. The blank of FIG. 13 has numerous portions which correspond to the blank of FIG. 3, these portions are designated by the same reference numbers as previously and will not be described again. Contrary to the blank of FIG. 3, the bottoms 2 are not connected by an intermediate face but are separated by a narrow slit 52. On the other hand, the faces 4 belonging to the two portions of the container are directly connected together at their coresponding ends along fold lines 53, which represent the axis of articulation 35 (compare FIG. 9).

Figure 14:
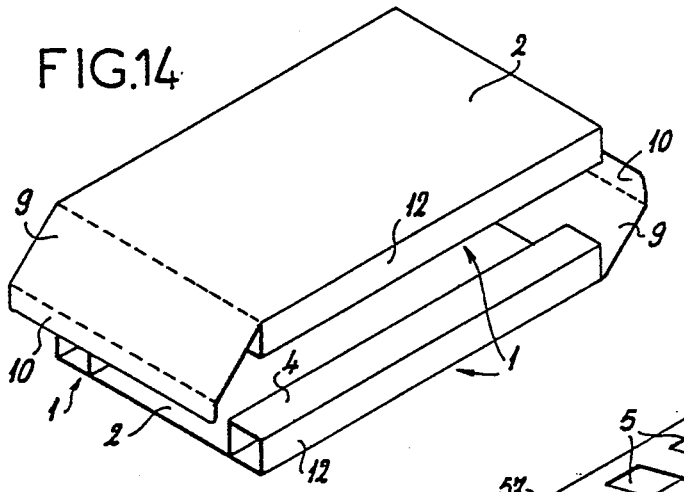
FIG. 14 is a view in perspective of another embodiment of the container of the invention, obtained by means of two identical "half boxes"

FIG. 14 shows another equivalent embodiment of the container for ampules in accordance with the invention, comprising again two portions, each of which consists of two hollow parallel supports 1 of rectangular section connected by a flat bottom 2. These two portions are initially separate and constitute two identical "half boxes" the bottom 2 of each of them being extended at one end by a foldable tab 9, which itself has a tongue 10. It will be understood that when the two half boxes are brought against each other to form a complete container, the tabs 9 assure the closing of the container at its two ends, the tongue 10 of each portion engaging the end of the other portion which does not have a tab 9.

Reference is again made here to FIG. 15 in order to explain how the stabilizing of the supports 1 can be effected not only by means of reinforcement flaps such as 20 and 21, but also by "double triangulation" using reinforcement elements 57 arranged within the supports 1 along a diagonal of their rectangular section.

Figure 15:
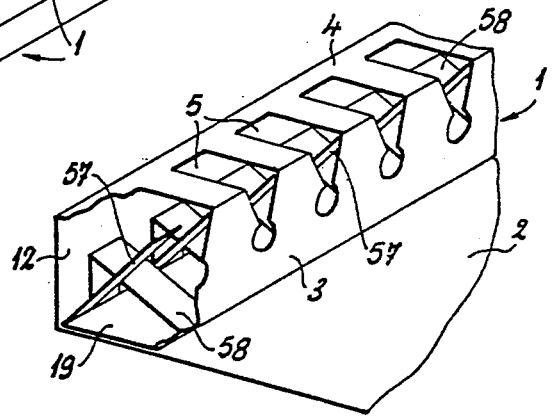
FIG. 15 is a partial view in perspective, partially torn away, of a container end in accordance with the invention, with reinforcement of the supports by double triangulation.

As shown in FIG. 15, the reinforcement of the supports 1 can be effected by this "double triangulation" by providing reinforcement elements 57 and 58 arranged within each support 1 along two perpendicular directions which intersect each other. These elements 57 and 58 can be formed of transverse tabs which originally protrude over the outer edge of the flap 19. The tabs 57 extend diagonally, starting from the lower outer corner of the support 1 and terminating at the upper inner corner thereof. The tabs 58 are bent so as to have a first portion which is in contact with the outer face 12 of the support and a second portion which extends perpendicularly to the inner lower corner of the support. It is to be noted that the tabs 57 alternate with the tabs 58 and that the latter are arranged facing the openings 5 while the tabs 58 are located between the openings 5, providing the space necessary for the tips of the ampules.

FIG. 16 shows a variant of this reinforcement by "double triangulation" which differs from the embodiment of FIG. 15 in the shape of the tabs 58. These tabs 58 in this case have three sections. The first is in contact with the outer face 12 of the support 1; the second extends perpendicularly up to an intermediate point on the base of the support; and the third, which is applied against the flap 19, extends to the inner lower corner of the support.

As shown in FIG. 17, which also shows a container with reinforcement of the supports 1 by "double triangulation", individual wedging of the ampules 6 can be effected by means of tongues 59 which are located in the plane of the upper faces 4 of the supports 1 and which protrude towards the inside. These tongues 59 are obtained in a very simple manner, as is evident also from FIG. 15, by not eliminating the portions of the initial blank which are intended to form the openings 5 but cutting them in outline while leaving them attached at one end to the upper face 4 of the corresponding support 1. The tongues 59 assure the holding of each ampule 6 and thus prevent the ampules 6 from detaching themselves in an undesired manner from their supports 1 upon the opening or closing of the container. These tongues 59 also have the function of preventing the inner and upper ampules from striking each other when the two parts of the container are brought against each other.

In order to make the wedging tongues 59 even more effective, one can provide, on the inner face 3 of each support 1, on opposite sides of each opening 5 which receives an ampule tip, notches 60 on which the tongues 59 are locked (see FIG. 18). As a variation, in the event that the supports 1 have a reinforcement element 54 which is arranged diagonally, the locking of the tongues 59 can be effected on the reinforcement element 54 by providing notches 61 for this purpose on said element. Depending on the position of the notches 61, the tongues 59 can retain a relatively straight shape (see FIG. 19) or assume a definitely bent configuration, in which case they contribute to the rigidity of the supports 1 and hold the ampules 6 by their tips (see FIG. 20).

In accordance with still another possibility, illustrated in FIG. 17, the wedging means for the ampules 6 are constituted, for each opening 5, by two tongues 70 and 71 which are attached on one of their sides to the upper face 4 of the support 1 of rectangular section.

In order to assure a perfect holding of the ampules whatever the dimensional tolerances of their tips, the openings 5 may also, as shown in FIGS. 21 and 22, have a special contour with a lateral nose 72, which may or may not pivot with respect to the inner face 3 of the support. In the case of FIG. 21, the overall shape of the opening remains symmetrical, the nose 72 pivoting along a symmetrical oblique line of the opposite edge of the opening 5. In the case of FIG. 22, on the other hand, the opening 5 has an asymmetrical shape, the nose 72 pivoting along a vertical line and a slit 73 being provided which is tangent to the lower point of the opening 5. These cutouts in the shape of a lateral nose 72 have essentially the function of retaining the ampules, particularly when one portion A or B is folded onto the other, and subsidiarily of absorbing variations in dimensions of the ends of these ampules. It should be noted that the holding of the ampules, whether effected by tongues 59, 70, 71 or noses 72, is particularly interesting due to the mode of opening and closing the container forming the object of the invention, which consists of two portions A and B which are articulated to each other.

In the embodiments considered up to now, the supports 1 have a substantially square section, their height h being indicated in some of the figures as approximately equal to the diameter of the ampules 6. FIG. 23 shows, in the form of a diagrammatic cross section, another container in accordance with the invention in which the supports 1 have a rectangular section, with a height H greater than previously and, in particular, definitely greater than the diameter of the ampules 6. The latter are placed as close as possible to the bottoms 2 of the two portions of the container which provides, between the four supports 1 and the two rows of ampules 6 of the container, a free central space which can easily receive blister cards 62 of tablets or any other form of packing of small thickness containing an additional medication or an accessory, such as a syringe or the like.

According to the same idea the FIG. 24 shows a container in accordance with the invention which is designed to receive an accessory 63, such as an accessory intended for opening the ampules 6 contained in this container. For this purpose, the supports 1 are extended at one end of the container, such as that having the closure tab 9, over a length greater than the space necessary for the last ampules 6 of the two rows of ampules. The accessory 63, which may be of the type forming the object of French Pat. No. 76.38440 in the name of the Applicant, is housed within the free space which is thus provided at one end of the container. As a variation, one of the spaces between the openings 5 which receive the tips of the ampules 6 can be made larger than the others, thus providing a free space in an intermediate region to receive an accessory.

Figure 25:
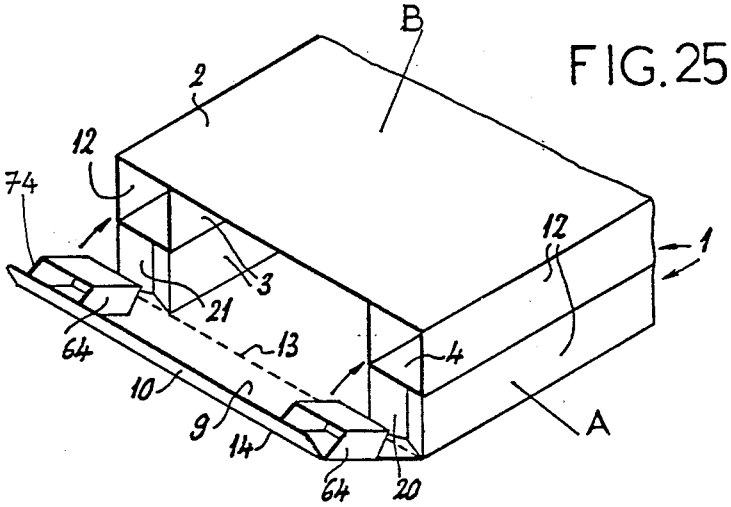
FIG. 25 is a partial view in perspective of another embodiment of the container of the invention in which the closure tab bears a part of the reinforcing means for the supports.

FIG. 25 shows still another embodiment of the container in accordance with the invention, in which the reinforcement of the supports 1 is partially assured, at one end of the container, by the closure tab 9. The two supports 1 of the portion which is provided with this tab 9 are strengthened by one of the means described previously, such as the double flaps 20, 21. On the other hand, the two supports 1 of the other portion of the container do not have flaps of this kind and therefore have an open end. On the inner face of the tab 9 there are provided protruding lateral elements 64 of rectangular section located opposite the supports 1, having a shape complementary to the section of said supports. When the tab 9 is used to close the container, the two elements 64 introduce themselves forcefully into the two supports 1 which have open ends, thus assuring the rigidity of these supports. In order to permit the introduction of the reinforcements 64, it is necessary that their upper face 74 be slightly bevelled.

Figure 26:
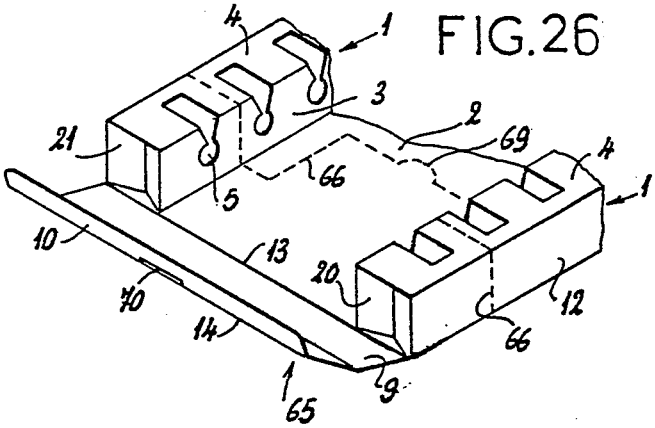
FIG. 26 is a partial view in perspective of a last embodiment of the container of the invention, having a detachable portion intended to constitute a case for a single ampules.
Figure 27:
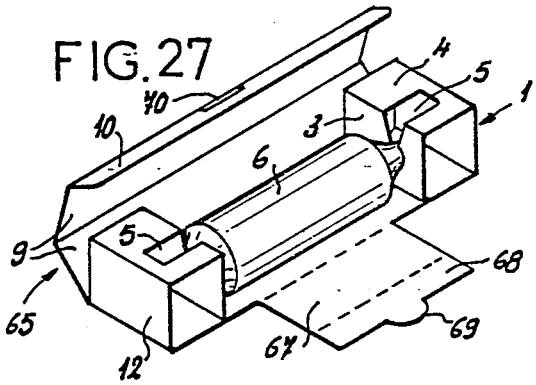
FIG. 27 shows in perspective the case for a ampule separated from the container of FIG. 26.

Finally, FIGS. 26 and 27 show a container in accordance with the invention having, in particular, reinforcement flaps 20, 21 at the ends of these supports 1, which has a detachable portion 65 intended to constitute a case for a single ampule 6. This portion is separated along a line 66 (see FIG. 26) which is precut in the complete container by the manufacturer thereof. The precut line 66 passes through two supports 1 of the portion of the container which has the closure tab 9, so as to separate the ends of the supports 1 facing the said tab 9. More precisely the line 66 passes here also across the entire width of the bottom 2, not along a straight line but along a broken line so as to define an auxiliary tab 67, extended by a tongue 68 which in its turn has a central lug 69.

Before the removal of the detachable portion 65, the container is identical to that of FIGS. 1 to 4, for instance. After removal of the detachable portion 65 along the precut line 66, said portion forms a sort of case, shown in FIG. 27 which receives an ampule held between the two sections of supports 1 separated from the rest of the container. The closure tab 9 is folded onto the upper faces 4 of these two support sections and the complete closing of the case is effected by raising the auxiliary tab 67 and introducing the lug 69 of its tongue 68 into a slit 70 provided in the middle of the fold line 14, which separates the tab 9 from its tongue 10. The case, which is thus closed, permits the safe carrying along of an ampule 6 for ambulatory treatment. Depending on the daily dose prescribed, cases for two or even more ampules can also be produced based on precisely the same principle.

It will also be noted that while the container shown in the drawings is intended for conventional ampules 6 having two tips, the invention also applies, without any particular difficulty, to bottle-ampules and bottles or any other equivalent receptacle. Depending on the specific case, it is sufficient to provide in the supports 1 and possibly in the inner reinforcement elements openings and cutouts of suitable shapes and dimensions. The division of the container into two portions also makes it possible to place together without mixing two types of ampules or the like, for instance for two products to be combined in a treatment, with all imaginable variation as to size and shape.

It has been known for a long time to produce double racks connected by a hinge (French Pat. No. 1,291,675, cited in the preamble). It was also known to reinforce the lateral supports (Patent of Addition 72.562 to French Pat. No. 1,114,066, cited in the preamble). While each of these two solutions by itself requires the use of a case or of a sheathing which was frictionally engaged, it could not be foreseen—and this is what is unexpected—that the simple combination of the general means taught by these two patents would make it possible to produce complete single-piece containers, particularly as:

on the one hand, this solution effectively improves the product and results in a substantial saving in raw materials, especially as a result of the elimination of the case, which saving may even be more than 50% of the raw materials.

Furthermore, no specialist confronted with this problem arrived at this solution despite the long period of time which elapsed between each of the documents cited and the solution which forms the object of the invention.

In other words, the invention was not obvious, even to a man skilled in the art.

As goes without saying and as is already evident from the foregoing, the invention is not limited solely to the embodiments of this container for pharmaceutical ampules and the like which have been described above by way of example; rather, it covers all embodiments comprising equivalent means, especially with respect to the reinforcement of the supports and, of course, whatever the methods of manufacture and assembly (gluing, stapling, clipping).

To avoid the knock of the ampules an interpolated sheet is introduced to maintain the said ampules 6 at the bottom of the openings 5.

Figure 29:
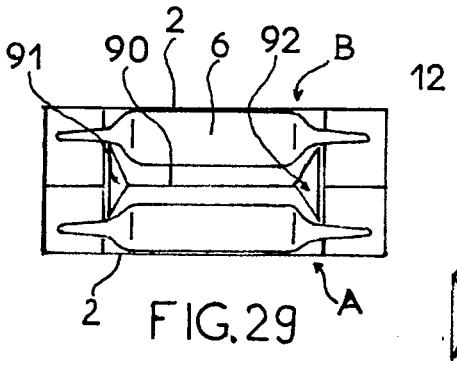
Figure 30:
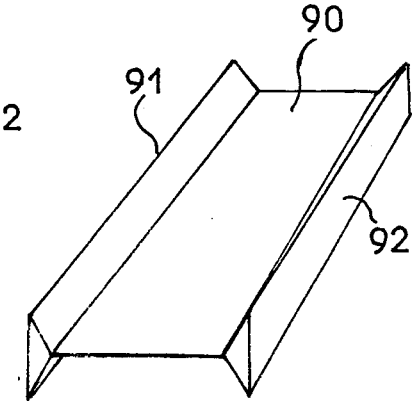

In a first realization, this interpolated 90 (see FIGS. 29–30) has a width equal to the distance between two supports 1, face to face, and a length substantially equal to this one occupied by the ampules. Each extremity 91 and 92 of this interpolated 90 shows means to dwell on the epaulement of the ampules in order to maintain the end at the bottom of the openings 5. This means can have a triangular section 93 or similar (cylindrical, T form). Indeed, this interpolated 90 can received instructions for the consumer. This solution is advantageous to decrease the weight of the card board (on about 20%).

Figure 31:
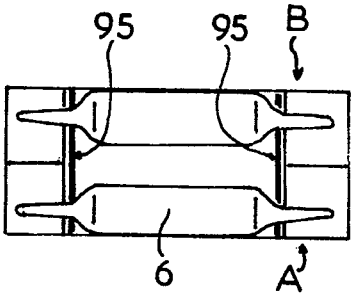
Figure 32:
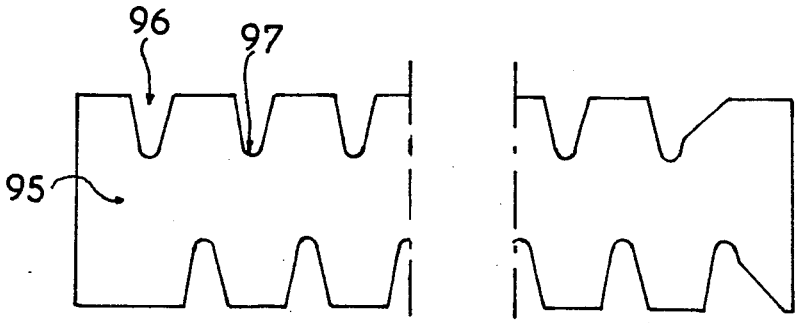

In a second realization (see FIGS. 31–32) the interpolated 95 is located in front of each support 1 and into a perpendicular plane to the flat bottom 2. In each interpolated 95, there are several openings 96 where are located the ends of the ampules 6 and which are ordered in front of the openings 5. The bottom 97 of these openings 96 maintain the ends of the ampules 6 during falls and avoid that ampules of portion A knock the ampules of portion B.

I claim:

1. An improved container for pharmaceutical ampules or the like, cut from a single blank of cardboard or the like, forming a first and a second foldable unit portion, each of said first and second foldable unit portions comprising:

(a) a first and a second hollow parallel lateral support, each of said supports having a first and second end, four rectangular faces, and a rectangular cross-section; said lateral supports also having a plurality of openings adapted to receive end parts of said ampules;

(b) a flat bottom connecting together said first and second supports and forming a first of said four rectangular faces which form each said support;

(c) a plurality of articulated flaps, one of said flaps being adjoined to each respective end of said first and second lateral supports at one of said second, third, and fourth rectangular faces, said articulated flaps adapted to be folded against the ends of said lateral supports;

(d) a rectangular hinge face at the first end of said first and second supports, said hinge face being adjacent to and connected with a similar hinge face on the other of said first and second foldable unit portions and having a height substantially equal to the height of the lateral supports;

(e) a closure tab at an end of said flat bottom corresponding to the second end of said first and second supports;

(f) first, second, third, and fourth securing means;

said first and second securing means securing said rectangular hinge face to the articulated flaps located at the first end of said supports;

said third and fourth securing means securing said closure tab to the articulate flaps located at the second end of said supports.

2. A container for pharmaceutical ampules or the like as recited in claim 1, further comprising:

a locking system formed by one of said closure tabs in cooperation with the other said closure tab.

3. A container for pharmaceutical ampules or the like as recited in claim 1, wherein said securing means is a glue bond.

4. A container for pharmaceutical ampules or the like as recited in claim 1, wherein said adjacent hinge faces of said first and second foldable unit portions have a folding line formed therebetween.

* * * * *